US005898444A

United States Patent [19]

Kobayashi et al.

[11] Patent Number: 5,898,444

[45] Date of Patent: Apr. 27, 1999

[54] INK JET TYPE RECORDING APPARATUS HAVING A CAPPING DEVICE AND A CAM FOLLOWER

[75] Inventors: Atsushi Kobayashi; Kazuhisa Kawakami; Seiji Mochizuki; Masahiro Isono; Shigenori Fukasawa; Nobuhito Takahashi, all of Nagano, Japan

[73] Assignee: Seiko Epson Corporation, Tokyo, Japan

[21] Appl. No.: 08/661,595

[22] Filed: Jun. 11, 1996

[30] Foreign Application Priority Data

Jun. 13, 1995 [JP] Japan ..... 7-170361

[51] Int. Cl.[6] ..... B41J 2/165

[52] U.S. Cl. ..... 347/29

[58] Field of Search ..... 347/29, 30, 32, 347/44; 417/477.1, 477.3, 477.5, 477.7, 477.8

[56] References Cited

U.S. PATENT DOCUMENTS

| | | | |
|---|---|---|---|
| 3,787,148 | 1/1974 | Kopf | 417/477 |
| 4,363,609 | 12/1982 | Consentino et al. | 417/477 |
| 5,260,724 | 11/1993 | Tomii et al. | 347/32 |
| 5,309,180 | 5/1994 | Uchida | 347/30 |
| 5,517,219 | 5/1996 | Uchida | 347/24 |

FOREIGN PATENT DOCUMENTS

| | | | |
|---|---|---|---|
| 0 423 475 | 4/1991 | European Pat. Off. | B41J 2/165 |
| 0499484 | 8/1992 | European Pat. Off. . | |
| 0 576 033 | 12/1993 | European Pat. Off. | B41J 2/165 |
| 0 604 067 | 6/1994 | European Pat. Off. | B41J 2/165 |
| 0604067 | 6/1994 | European Pat. Off. . | |
| 6-143613 | 5/1994 | Japan | 347/30 |

*Primary Examiner*—N. Le
*Assistant Examiner*—L. Anderson
*Attorney, Agent, or Firm*—Sughrue, Mion, Zinn, Macpeak & Seas, PLLC

[57] ABSTRACT

An ink jet type recording apparatus in which two recording heads are mounted on one and the same carriage in such a manner that their spatial relationship is fixed, and the heads are positively sealed simultaneously by a capping means. A first cap member 13 adapted to seal the first recording head is provided near an end, proximate to the printing region, of a slider 20, which lifts a base stand according to the movement of a carriage. The first cap member has an air communication hole, and an ink suction hole therein. In addition, a second cap member 14 adapted to seal the second recording head is mounted through elastic members 74 and 75 on the slider 20. The second cap member 14 has an air communication hole, and an ink suction hole therein. The end of the slider 20, proximate to the non-printing region, is supported with an arm 30 which is elastically pressed vertically upwardly of the printing region. The two cap members are fixedly spaced from each other. The first cap member, is slidingly fitted over the first recording head by means of elastic members 31 and 32, thereby making sealing contact with the first recording head; while similarly the second cap member, is slidingly fitted over the second recording head by means of elastic members 74 and 75 interposed between the second cap member and the slider, thereby making sealing contact with the second recording head.

12 Claims, 9 Drawing Sheets

92
122
120
110
116
101b
101
101a
131
134
132
136
146
140
144
150
141
142
135
130
115
112
124
102a
102
102b
94
108
241
95
106
125
121
113
118
104b
104
104a
B
A
123
111
117
151
103a
103
103b
93
91
108a
105
143

INK JET TYPE RECORDING APPARATUS HAVING A CAPPING DEVICE AND A CAM FOLLOWER

The following disclosure is based on Japanese Patent Application No. Hei. 7-170361 filed on Jun. 13, 1995, which is incorporated into this application by reference.

BACKGROUND OF THE INVENTION

1. Field of the Invention

This invention relates to an ink jet type recording apparatus in which its recording head is moved in the direction of width of a recording sheet, and ink droplets are jetted onto the recording sheet in accordance with printing data, to form an image thereon, and more particularly to a capping device suitable for sealing the recording head, and to a pump unit for supplying negative pressure to the capping device.

2. Description of the Related Art

An ink jet type recording apparatus in which, with ink pressurized in a pressurizing chamber, ink droplets are jetted onto the recording sheet thereby to record printing data, suffers from difficulties that, because of evaporation of solvent from the nozzle opening, the ink is increased in viscosity, or solidified, or foreign matters such as dust stick onto the nozzle opening, and because of the formation of bubbles in the ink, the resultant print is unacceptable. In order to overcome the above-described difficulties, the ink jet type recording apparatus has capping means for sealingly closing the nozzle opening when the apparatus is not in operation, and cleaning means for cleaning the nozzle plate when necessary.

The teachings of Japanese Patent Application (OPI) No. 125239/1989 (the term "OPI" as used herein means an "unexamined publication application") disclose an ink jet type recording apparatus having a sled which is pushed and moved by the carriage moving to the home position. The sled is moved along a sloped guide surface of a frame to the nozzle opening surface of the recording head, so that a rubber cap formed on the surface of the sled is pressed against the recording head to sealingly close the nozzle opening.

Furthermore, Japanese Patent Application Publication No. 13910/1990 disclosed the following ink jet type recording apparatus: In the apparatus, in order to press a cap against the recording head, two arms forming a parallelogram link are interposed between the frame and the cap, so that the cap is moved horizontally by the carriage while being moved vertically towards the head.

The amounts of vertical movement of the above-described means are determined by the sloped guide surface of the frame, and the parallelogram link, respectively. Therefore, in the case where the distance between the path of movement of the carriage and the frame is somewhat varied because of tolerances in machining or assembling the components, or in the case where, in order to print data on a recording sheet relatively large in thickness such as an envelope, the distance between the platen and the recording head is adjusted, thus changing the distance between the recording head and the cap. Hence, the sealing of the nozzle opening depends on the elastic deformation of the cap itself. This poses no problem in the case where the surface to be sealed is small; however, it is considerably difficult to uniformly seal the entire surface of a recording head having a number of nozzles.

The teachings of Japanese Patent Application (OPI) No. 103762/1984 disclose the following means: At the home position of the carriage, an inverted-L-shaped head protective cover having a cap at one end is swingably supported. The protective cover is swung by the carriage when moved to the home position, so that its cap is pressed against the recording head. With the above-described means, the amount of swing of the protective cover changes according to the distance to the nozzle surface. Hence, the means can provide a positive sealing effect even for the recording apparatus which is so designed that the distance between the platen and the printing head is adjustable. However, it suffers from the following problem: Since the direction of movement of the recording head is different from that of the cap, the relative movement of the recording head and the cap may deform the latter; that is, the cap is liable to be broken.

SUMMARY OF THE INVENTION

In order to solve the above-described problems, the present Applicant has proposed the following recording apparatus. As disclosed by Japanese Patent Application (OPI) No. 8460/1994, the apparatus comprises: a capping device and a cam follower. The capping device is arranged outside the printing region, and is pushed by the recording head or the carriage bearing the recording head. This movement allows the capping device to move between a non-capping position and a capping position by means of a cam surface which, while the recording head is moved from the non-capping position to the capping position, displaces the capping device to the nozzle surface of the recording head. With the apparatus, the capping device is positively elastically abutted against the nozzle plate merely by the movement of the carriage, thus positively sealing the recording head.

On the other hand, in a color printer in which a recording head for jetting black ink, and a recording head for jetting three kinds of ink different in color are mounted on one carriage, the arrangement of the ink tanks and other apparatus results in a large distance between the recording heads and therefore it is difficult to seal the recording heads with one and the same cap member.

On the other hand, an on-demand type ink jet recording apparatus suffers from difficulties that, because of evaporation of ink solvent from the nozzle opening, the ink is increased in viscosity, or dried, or foreign matter such as dust stick onto the nozzle opening, and because of the formation of bubbles in the ink the resultant print is unacceptable. Hence, in the apparatus, negative pressure is provided by a suction pump and applied to the capping means, so that the ink is forcibly discharged from the recording head, to eliminate the clogging of the recording head.

The above-described suction pump is generally a tube pump which is simple in construction and can be miniaturized. In the tube pump, a tube is squeezed with two pulleys which are arranged symmetrically with respect to the center of rotation. Hence, if the tube pump is reduced in size, then the part of the tube against which the two pulleys abut at the same time is relatively large. Hence, as shown in the part (*b*) of FIG. 13, the application of a great load occurs momentarily, which makes it impossible to allow the pump to perform a smooth suction operation.

It has been tried to reduce the diameter of the pulleys. However, the reduction of the pulley diameter increases the friction between the pulleys and the tube, thus obstructing the smooth driving of the pulleys. On the other hand, it is possible to reduce the diameter of the tube. However, if the tube diameter is reduced, then the suction performance of the pump is lowered, which gives rise to other problems; for instance, it becomes necessary to drive the pump at a higher speed.

In view of the foregoing, a first object of the invention is to provide an ink jet type recording apparatus with a capping device which is able to positively seal two recording heads mounted on one and the same carriage.

A second object of the invention is to provide an ink jet type recording apparatus with a pump unit for applying a negative pressure to the aforementioned capping device that exhibits less load, less torque variation than the related art and can be miniaturized. It is a further object of the invention to provide a pump unit allowing the overall recording apparatus to be miniaturized.

The foregoing objects of the invention are achieved by the provision of the following means:

The first means is an ink jet type recording apparatus which, according to the invention, comprises:

a carriage on which a first recording head for jetting black ink towards a printing region, and a second recording head for jetting color ink towards a non-printing region are mounted; and capping means including:

a slider for vertically moving a base stand in accordance with the movement of the carriage;

a first cap member adapted to seal the first recording head, the first cap member being fixedly provided near an end of the slider, proximate to the printing region, and having an air communication hole and an ink suction hole therein;

a second cap member adapted to seal the second recording head, the second cap member being mounted through elastic members on the slider, proximate to the non-printing region, and having an air communication hole, and an ink suction hole therein;

an arm provided in a region below the first cap member, to perform a supporting operation in such a manner as to describe an arcuate path as the carriage is moved; and an elastic member adapted to elastically push the arm vertically upwardly of the printing region.

The second means is an ink jet type recording apparatus which, according to the invention, comprises:

a carriage on which two ink jet type recording heads are mounted; two cap members which are adapted to seal the nozzle openings of the recording heads, respectively; and a pump unit for applying negative pressure to the cap members, the pump unit comprising:

a pump frame having tube supporting surfaces which are set back to back to deform tubes until the tubes are substantially semi-circular in section; and two pump wheels turned by the drive power of drive means;

two pulleys rotatably engaged with grooves formed in each of the pump wheels in such a manner that, when rotated in one direction, the pulleys are positioned in diametrical symmetry with respect to the center of rotation of the pump wheel, thereby squeezing the tube, and when rotated in the opposite direction, the pulleys are moved away from the tube, and in the pump frame, the maximum contact region of the tube and the pulleys ranges from 160° to 180°.

The two cap members are fixedly spaced from each other. The first cap member, is slidingly fitted over the first recording head by means of the elastic members at the end of the slider, thereby making sealing contact with the first recording head; while similarly the second cap member, is slidingly fitted over the second recording head by means of the elastic members interposed between the second cap member and the slider, thereby making sealing contact with the second recording head.

Since the maximum contact angle of the pump tube and the pulleys is smaller than 180°, the amount of load required when the abutment of the pulleys against the tube is relieved is substantially equal to that which is required when the tube is squeezed. In addition, the pump frame accommodates the damper tubes, which contributes to a miniaturization of the ink jet type recording apparatus of the invention.

DETAILED DESCRIPTION OF THE PREFERRED EMBODIMENTS

This invention will be described in detail with reference to its preferred embodiment shown in the accompanying drawings.

Figure 1:
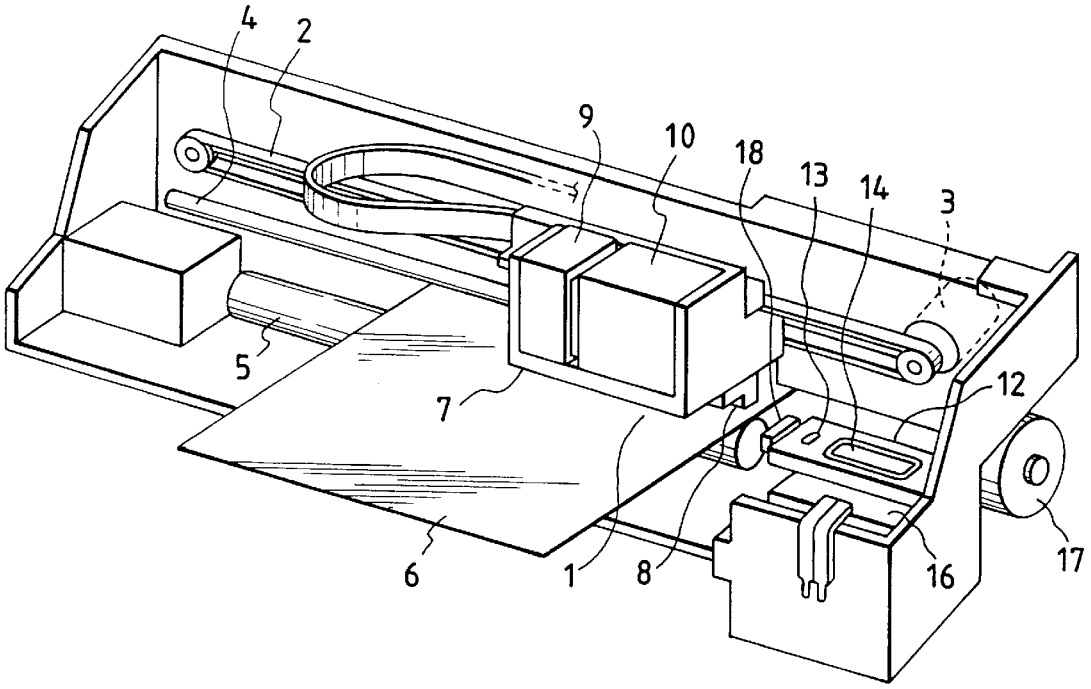
FIG. 1 is a perspective view showing part of an ink jet type recording apparatus, which constitutes the preferred embodiment.

The embodiment of the invention is as shown in FIG. 1. In FIG. 1, reference numeral 1 designates a carriage which is coupled through a timing belt 2 to an electric motor 3, so that it is moved in parallel with a platen 5 while being guided by a guide member 4. On the surface of the carriage 1 which is confronted with a recording sheet, a black ink jetting recording head 7 is provided; more specifically, it is provided in a printing region (on the left side of FIG. 1), and furthermore a color printing recording head 8 is detachably provided in a non-printing region. The recording heads 7 and 8 receive inks from a black ink cartridge 9 and a color ink cartridge 10, respectively, to jet ink droplets onto the recording sheet 6.

Further in FIG. 1, reference numeral 12 designates a capping device in which a specific feature of the invention resides. The capping device 12 is designed as follows: The capping device 12 comprises: a cap member 13 adapted to seal the black ink recording head 7, and a cap member 14 adapted to seal the color ink recording head 8, which are mounted on one and the same slider. The capping device is connected through tubes to a pump unit 16 comprising two tube pumps. The size of the capping device is such that the nozzle openings of the recording heads 7 and 8 are sealed with one space. When no printing operation is carried out, the capping device closes the nozzle openings. When a jetting capability restoring operation is carried out, the capping device receives a negative pressure from the pump unit 16 which is driven by an electric motor 17 adapted to drive a sheet feeding roller (not shown), to cause the recording heads 7 and 8 to forcibly jet inks. A cleaner unit 18 is provided near the capping device 12, which is moved up and down by the motor 17.

Figure 2:
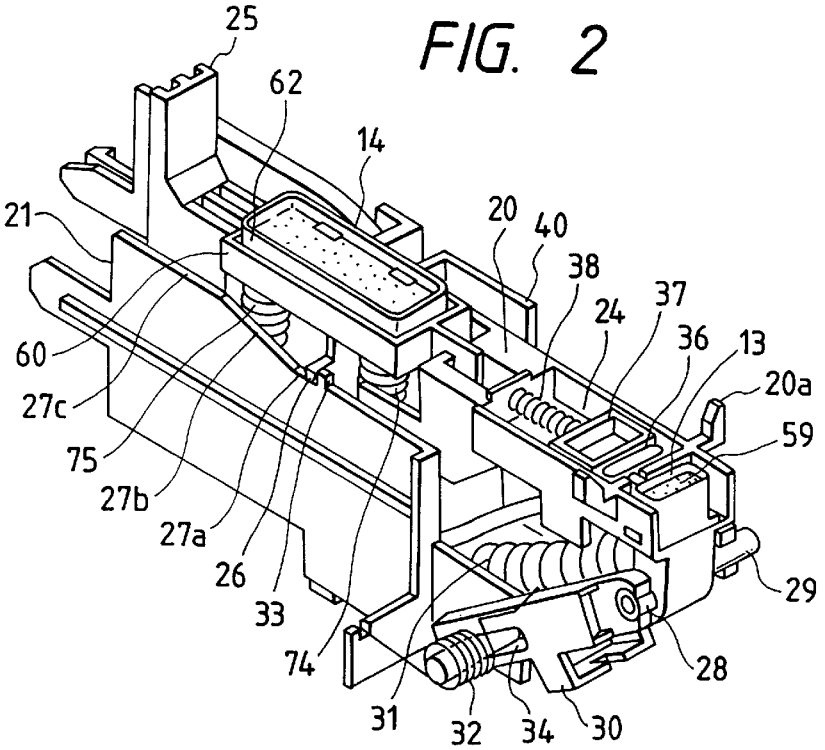
FIG. 2 is a perspective view showing an example of a capping device in the embodiment.
Figure 3:
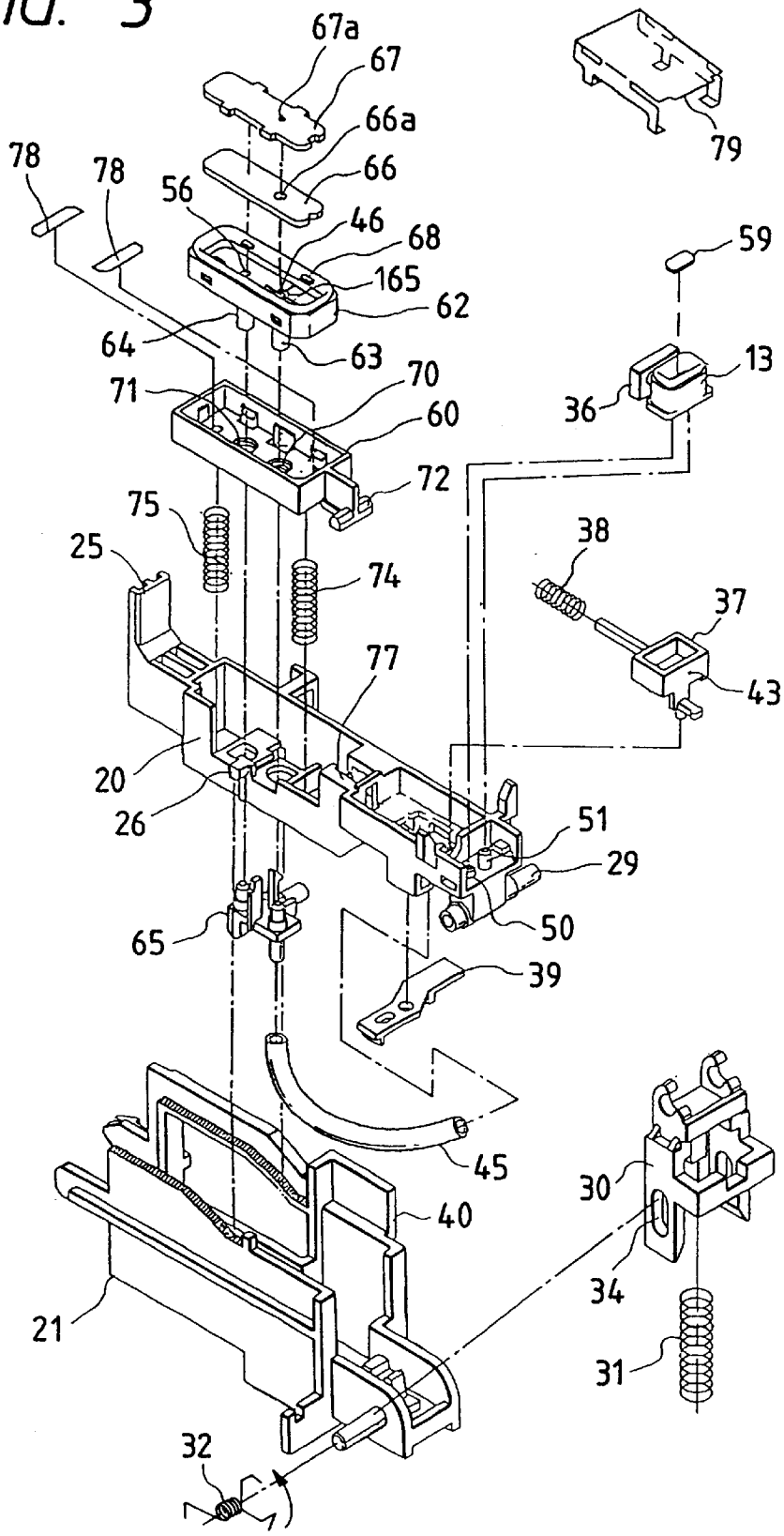
FIG. 3 is an assembling exploded view of the capping device shown in FIG. 2.
Figure 4:
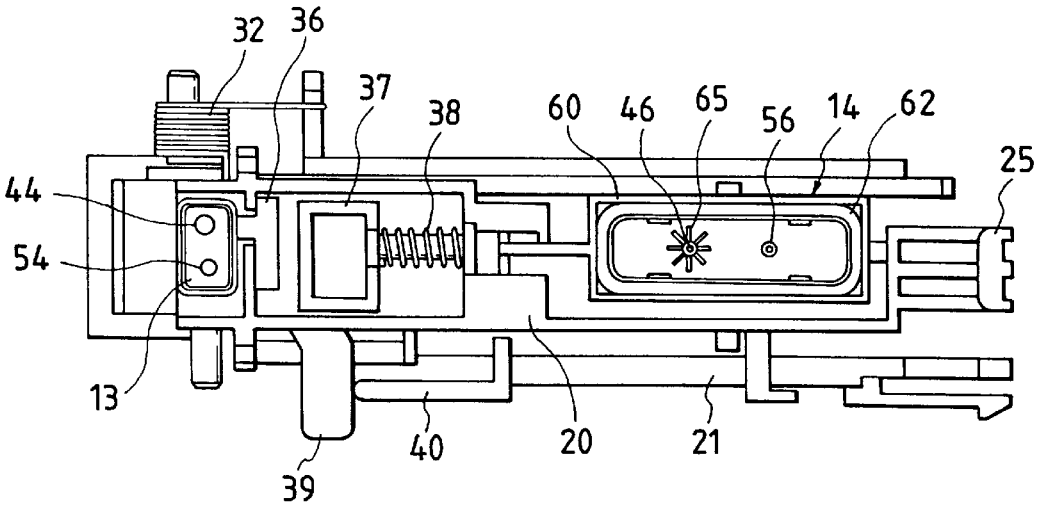
FIG. 4 is a top view of the capping device with its ink absorbing sheet removed.

FIGS. 2, 3 and 4 show an example of the capping device according to the invention. In those figures, reference numeral 20 designates a slider which is designed as follows: When the carriage 1 is moved toward the non-printing region, the slider 20, following the movement of the carriage 1, is moved horizontally and vertically over the upper surface of a base stand 21. In the upper surface of the capping device, the cap member 13 for sealing the black ink recording head 7 is provided at the end of the slider proximate to the printing region (at the right end in FIG. 2), and the cap member 14 for sealing the color ink recording head 8 is provided substantially at the middle of the printing region. A normally closed valve unit 24 is provided between cap members 13 and 14, which is released by a lever 39 (described later). Furthermore, the capping device has a flag piece 25 at the outermost end which is abutted against the carriage 1.

The slider 20 has a protrusion 26 near the lower end of the cap member 14 adapted to close the color ink recording head. As the carriage is moved, the protrusion and accordingly the slider is moved along the guide surface of the base stand 21 which is made up of a low guide surface 27*a*, sloped guide surface 27*b*, and a high guide surface 27*c*.

The slider 20 has other protrusions 28 and 29 near the lower end of the cap member 13 adapted to seal the black ink recording head 7. The slider 20 is supported by an arm 30 whose one end is coupled to the base stand 21 in such a manner that the arm 30 is swingable with the aid of an elongated groove 34. A compression spring 31 is interposed between the bottom of the slider 20 and the base stand 21, while a twist spring 32 is interposed between the arm 30 and the base stand. The elastic forces of those springs cause the protrusion 26 to abut against a stopper 33, so that a space suitable for receiving ink droplets from the recording heads is provided, while urging the slider 20 obliquely upwardly so that it is held horizontal.

One of the protrusions 28 and 29 engaged with the arm 30 has a through-hole, which is communicated with an ink suction hole 54 of the cap member 13 (described later), thus providing a flow path.

The valve unit is designed as follows: It comprises a stationary valve seat 36, movable valve seat 37, and compression spring 38. The movable valve seat 37 is elastically pushed against the stationary valve seat 36 by means of the spring 38, and, when a lever 39 is abutted against a protrusion 40 of the base stand, a gap is formed. The stationary valve seat 36 and the movable valve seat 37 have through-holes 42 and 43, respectively, which are closed by the opposite valve seats. The through-hole of the stationary valve seat 36 is communicated with an air communication hole 44 of the cap member 13 adapted to seal the black ink recording head 7, while the through-hole 43 of the movable valve seat 37 is communicated through a tube 45 with an air communication hole 46 of the cap member 14 adapted to seal the color ink recording head 7.

The cap member 13 adapted to seal the black ink recording head 7 is designed as follows: A cup is formed with elastic material such as rubber, the air communication hole and ink suction hole 54 are formed therein as shown in FIG. 4, and tubular paths 57 and 58 are formed therein which are connected to connecting mouths 50 and 51 of the slider 20. In addition, an ink absorbing sheet 59 is set in the bottom.

Roughly stated, the cap member 14 adapted to seal the color ink recording head 8 is made up of a cap 62 and a supporting frame 60 holding the cap 62.

The cap 62 is designed as follows: A cup is formed of ink resisting synthetic resin or rubber. In the region of the cup thus formed which is not confronted with the nozzle opening array, as shown in FIG. 4 the air communication hole 46 and an ink suction hole 56, and conduit pipes 63 and 64 communicated with those holes 46 and 56 are formed. Radial grooves 65 are formed around the air communication hole 46 in such a manner that the former are integral with the latter.

In the cap 62, two ink absorbing sheets 66 and 67 made of ink absorbing porous material is set in such a manner that they substantially cover the bottom and are fixedly retained with protrusions 68 formed on the inner annular surface of the cap 62. Those ink absorbing sheets 66 and 67 have small-diameter through-holes 66*a* and 67*a*, respectively, which are in alignment with the air communication hole 46.

On the other hand, the supporting frame 60 has holes 70 and 71 into which the conduit pipes 63 and 64 of the cap 62 are inserted, and a guide member 72 whose lower portion is spread towards the end of the valve unit. Compression springs 74 and 75 are interposed between the supporting frame and the slider 20. The supporting frame 60 is secured to the slider 20 through a connecting member 165 which is connected to the conduit pipes 63 and 64.

The guide member 72 is engaged with a guide groove 77, inverted-V-shaped in section, which is formed in the slider 20; that is, it functions to move the whole supporting frame 60 so that, when the cap member 14 abuts against the recording head 8, the supporting frame is centered.

In FIG. 3, reference numerals 78 and 78 designate sheets adapted to adjust the relative position of the supporting frame 60 and the cap 62; and 79, the cover of the valve unit.

When, in the above-described embodiment, the carriage 1 is moved to the non-printing region to confront with the capping device, the guide piece 20*a* (see FIG. 2) of the slider 20 is engaged with the color ink recording head 8, so that its position with respect to the recording head is a predetermined position in the direction of width of the recording head.

As, under this condition, the carriage 1 is further moved, it is abutted against the flag piece 25, so that the slider 20 is moved against the elastic forces of the springs 31 and 32. As a result, the protrusion 26 of the slider 20 is moved away from the stopper 33 of the base stand 21, and slid along the sloped guide surface 27*b*, so that the slider 20 is gradually raised, while the front end portion of the slider 20 is raised while being regulated by the arm 30.

Figure 5:
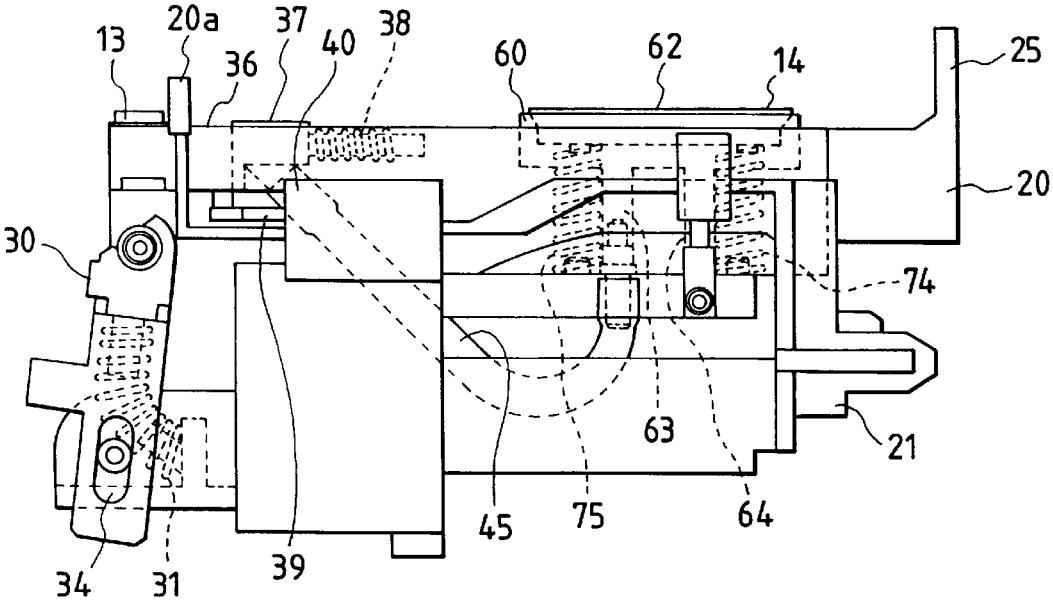
FIG. 5 is a sectional view showing a slider which has been moved to a capping position.
Figure 6:
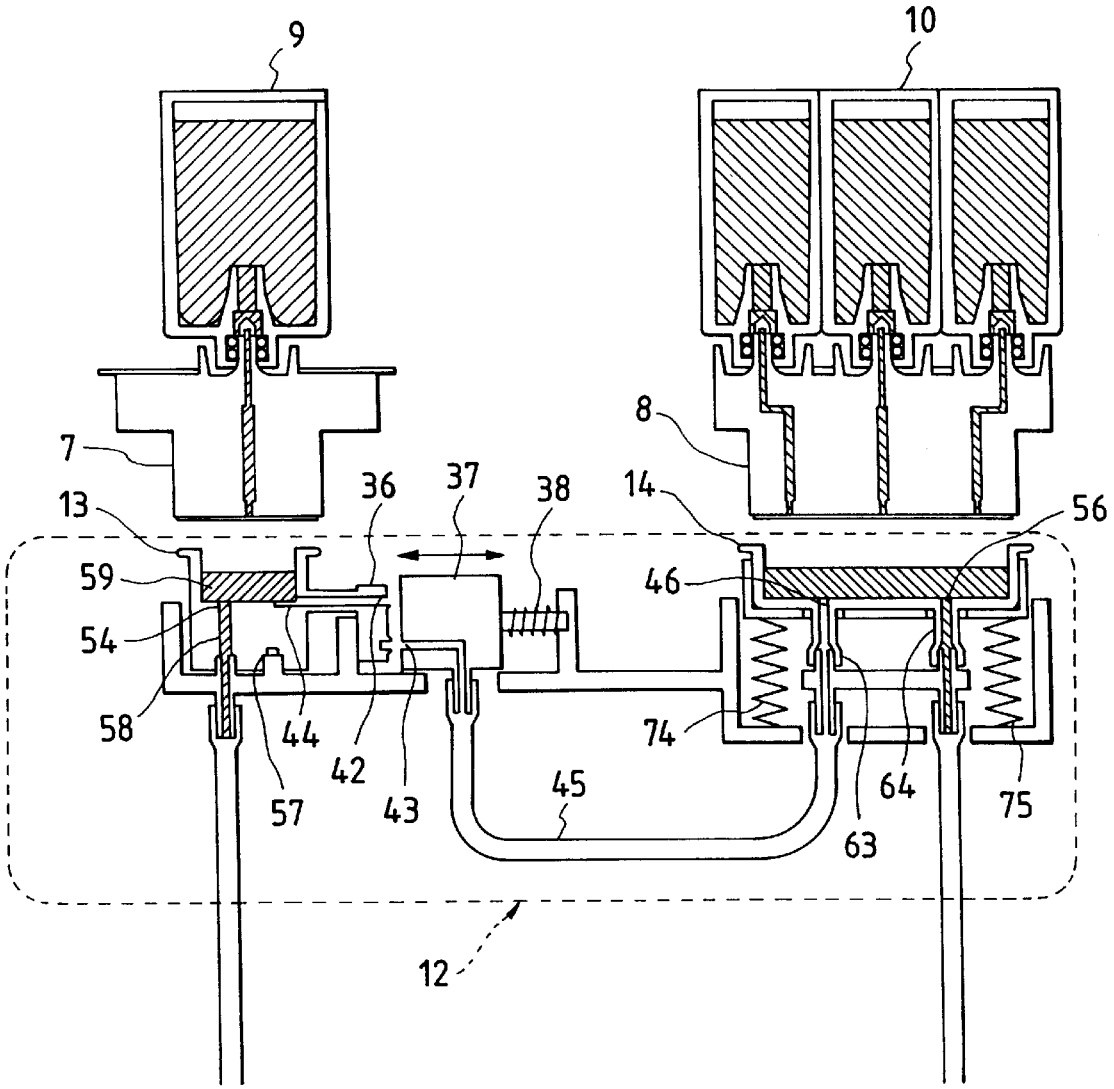
FIG. 6 is an explanatory diagram showing flow paths in the capping device.

When the slider is raised to the high guide surface 27*c* as shown in FIG. 5, the front end portion of the slider is raised to a position which is determined by the arm 30, so that the cap member 13 is elastically brought into contact with the black ink recording head 7 by the compression spring 31, while the cap member 14 is elastically brought in contact with the color ink recording head 8 by the springs 74 and 75 while its position with respect to the slider 20 being regulated by the guide member 72.

On the other hand, when it is required to forcibly jet ink from the recording heads 7 and 8, the pump unit 16 is operated with the heads capped. Under this condition, the lever 39 is not abutted against the base stand 21, and therefore the air communication holes 44 and 46 of the cap members 13 and 14 are sealingly closed by the valve unit 24.

Hence, negative pressure acts on the insides of the cap members 13 and 14 through the ink suction holes 54 and 56, so that ink droplets jetted from the nozzle openings reach the ink absorbing sheet, and small particles such as dust and paper powder are removed from the nozzle openings, while the bubbles in the recording head are discharged to the cap members 13 and 14 together with the inks.

When, after the inks are forcibly jetted in the above-described manners, the carriage 1 is further moved towards the non-printing region with the heads capped, the lever 39 is abutted against the base stand 21; that is, it is pushed to the right in the figure, so that the movable valve seat 37 is spaced away from the stationary valve seat 36.

As a result, air flows through the air communication holes 44 and 46 into the cap members 13 and 14, so that the waste inks in the ink absorbing sheets 59, 66 and 67 are sucked through the ink sucking holes 54 and 56 into a waste ink tank (not shown).

Radial grooves 65 are provided around the air communication hole 46 of the cap member 14, and the ink absorbing sheets 66 are very poor in gas permeability when being impregnated with waste ink. Hence, the air flowing into the cap member through the air communication hole 46 is spread through the radial grooves 65. Therefore, the wasted ink contained in the ink absorbing sheets 66 and 67 is allowed to flow into the cap member 14 without forming bubbles.

That is, if the radial grooves 65 were not present, air would collectively flow thereinto through the air communication hole 46, the velocity of flow of the air around the air communication hole would be extremely high, bubbling the waste ink nearby. As a result, minute particles such as dust and paper powder would stick onto the nozzle plate.

When the waste ink has been discharged from the cap members 13 and 14, the pump unit 16 is stopped, and the carriage 1 is moved towards the printing region. In this case, the frictional forces of the cap members 13 and 14 with the recording heads 7 and 8, and the elastic forces of the springs 31 and 32 move the slider 20 towards the printing region. During this operation, the lever 39 is disengaged from the base stand 21, and the movable valve seat 37 is elastically abutted against the stationary valve seat 36, and the cap members 13 and 14 are isolated from the outside air; that is, they (13 and 14) are held gas-tight.

When the carriage 1 is further moved towards the printing region, the slider 20 is slid down the sloped guide surface 27*b*, thus reaching the lower guide surface 27*a*. While the slide 30 is sliding down the sloped guide surface 27*b*, the cap members 13 and 14 are gradually moved downward, and accordingly the pressures in the cap members gradually returns to atmospheric pressure; that is, the nozzle plate will never be subjected to abrupt pressure change.

The cap members 13 and 14 are spaced from the recording heads 7 and 8 such that, ink drops leaked by flushing will never reach the recording heads 7 and 8. In this configuration, the flushing operation can be carried out without incident.

When the carriage 1 is further moved towards the printing region, the protrusion 26 of the slider 20 is engaged with the stopper 33 of the base stand 21, so that it becomes impossible for the slider 20 to follow the movement of the carriage 1 towards the printing region; that is, it is stopped while enabling the flushing operation.

Sometimes it is necessary to perform the flushing operating during a printing operation. In such an instance, the flushing operation can be carried out merely by moving the carriage to this position. After the printing operation is ended, the carriage is moved to the non-printing region, the recording heads are placed in a capped state through the above-described operations.

Figure 7:
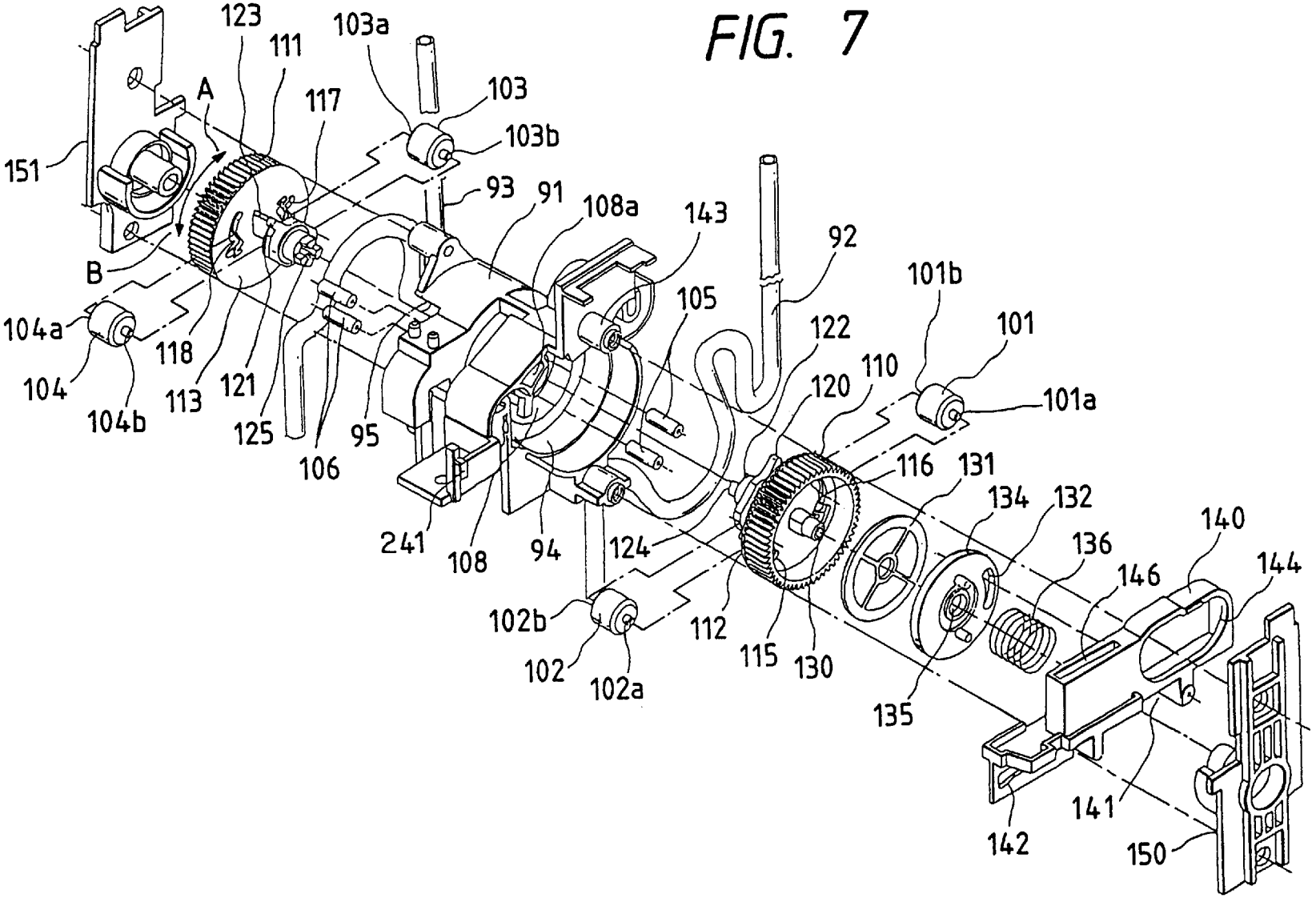
FIG. 7 is an assembling exploded view of an example of a pump unit in the embodiment of the invention.
Figure 8:
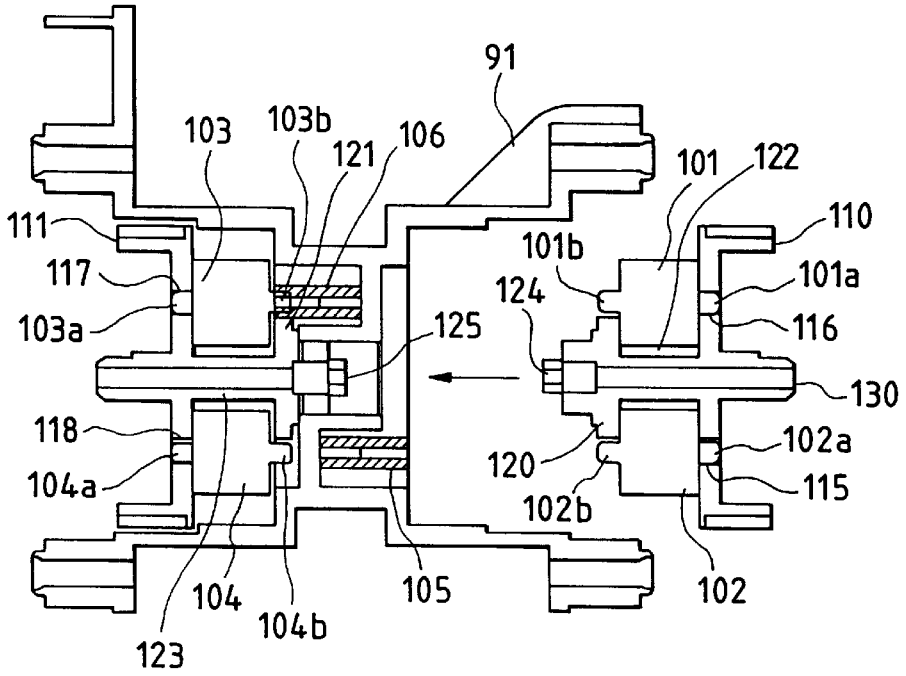
FIG. 8 is a sectional view showing the pump unit with its tubes removed.

FIG. 7 shows the pump unit and mechanisms around it. In FIG. 7, reference numeral 91 designates a pump frame serving as a base body, to which the above-described pump unit 16 and cleaner unit 18 are coupled.

The pump frame 91 is designed as follows: In order to apply negative pressures to the two cap members 13 and 14, it is necessary to form two tube pumps. For this purpose, the tubes 92 and 93 are allowed to have tube supporting surfaces 94 and 95 which support the middle portions of the tubes 92 and 93 in such a manner that they are substantially semi-circular and are set back to back. And those supporting surfaces 94 and 95 have lead-out points 96 and 97, and 98 and 99 at the ends thereof, respectively, which lead out the tubes 92 and 93 in alignment with the tangential lines to the supporting lines 94 and 95, respectively.

Figure 10A:
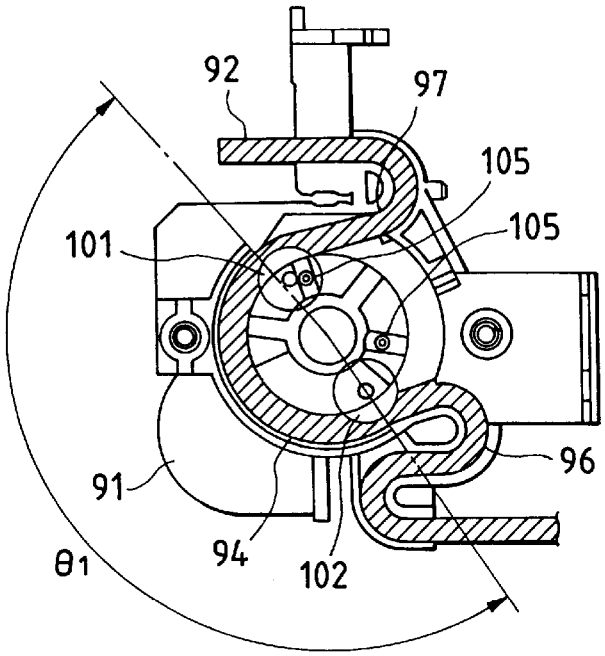
FIGS. 10(*a*) and 10(*b*) show relationships between tube and pulleys on one side of pump frame, and those between the tube and pulleys on the other side.
Figure 10B:
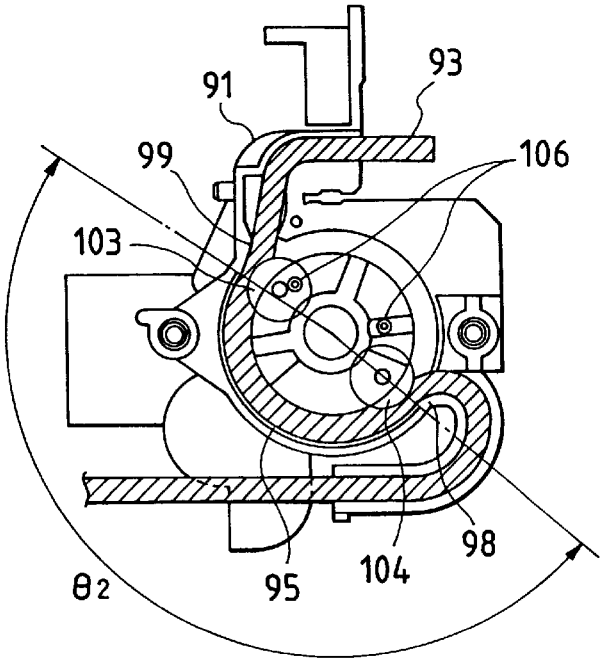

In the invention, the load torque which is applied to the motor when the pump is in operation, is made as constant as possible. For this purpose, the configurations of the tube supporting surfaces 94 and 95 and the positions of the lead-out points 96 through 99 are so determined that the central angles θ1 and θ2 (the parts (*a*) and (*b*) of FIG. 10) of regions squeezed by pulleys 101, 102, 103 and 104 are in a range of from 160° to 180° (173° in the embodiment).

In FIG. 7, reference numerals 105 and 106 designate damper tubes made of elastic material such as rubber. The rear ends of the damper tubes 105, 105, 106 and 106 are secured to a partition wall 108 of the pump frame 91 so that their front ends are on the loci of the pulleys 101 through 104.

Further in FIG. 7, reference numerals 110 and 111 designate pump wheels. The pump wheels are cylindrical external gears which are engaged with the motor 17 by means of change-over means (not shown). The pump wheels 110 and 111 have surfaces 112 and 113 which are confronted with the partition wall 108 of the pump frame 91. In those surfaces 112 and 113, pulley supporting grooves 115 and 116, and pulley supporting grooves 117 and 118 are formed, respectively, which support the rotary shafts 101*a* and 102*a* of the pulleys 101 and 102 and the rotary shafts 103*a* and 104*a* of the pulleys 103 and 104, respectively.

In contact with rotary shafts 101*b* and 102*b*, and 103*b* and 104*b* which are similarly formed on the side surfaces of the pulleys 101 and 102, and 103 and 104 being spaced from the pulley supporting grooves 115 and 116, and 117 and 118 as much as the length of the axes of the pulleys 101 and 102, and 103 and 104, shafts 122 and 123 are provided which have protrusions 120 and 121. The protrusions 120 and 121 are used to prevent the pulleys 101 and 102, and 103 and 104 from dropping, respectively, and are adapted to regulate the pulleys 101 and 102, and 103 and 104 in such a manner that those pulleys are positioned diametrically symmetrical with the pump wheels 110 and 111, respectively, when the pump is in operation.

Those shafts 122 and 123 have coupling sections 124 and 125 at the ends which are engaged with each other in the partition wall 108. That is, the shafts 122 and 123 are rotatably inserted into a through-hole 108*a* of the partition wall 108 of the pump frame 91, thus being supported by the latter 91.

As was described above, the pump wheels 110 and 111 have the pulley supporting grooves 115 and 116, and 117 and 118. Those grooves 115 and 116, and 117 and 118 are formed as paths which connect the outermost ends 115*a* and 116*a* and innermost end 117*b* and 118*b* of those grooves to the innermost ends 115*b* and 116*b* and outermost ends 117*a* and 117*b*. The outermost ends 115*a* and 116*a* and innermost ends 117*b* and 118*b*, when the pump wheels 110 and 111 are turned to drive the pumps as shown in the parts (*a*) and (*b*) of FIG. 9, move the pulleys 101 and 102, and 103 and 104 outwardly, to press the tubes 91 and 93 as much as a predetermined distance from the center of rotation, to function the latter 91 and 93 as pumps; whereas the innermost ends 115*b* and 116*b* and outermost ends 117*a* and 118*a*, when the pump wheels 110 and 111 are turned in the reverse direction, move the pulleys 101 and 102, and 103 and 104 towards the center of rotation to move them away from the tubes.

With respect to the pulley supporting grooves 114 and 116, and 117 and 118 of the pump wheels 110 and 111, angles θ3 and θ4 which are formed by connecting the centers of rotation and the outermost ends 115*a*, 116*a*, 117*a* and 118*a*, and the innermost ends 115*b*, 116*b*, 117*b* and 118*b*, are set to a predetermined value, 56° in the embodiment, so that no pumping action is induced. And the end of a cleaning blade 145 (described later) is able to move between a position (145' in FIG. 11) which is away from the nozzle plates of the recording heads 7 and 8 and a position (145 in FIG. 11) where it abuts against the recording heads 7 and 8.

In the space inside the pump wheel 110, a shaft 130 is provided. A clutch board 131 is coupled to the shaft 130 in such a manner that the clutch board 131 and the shaft 130 are not turned with respect to each other. The clutch board 131 is in contact with a cleaner cam board 134 having a cam groove 132 which is engaged with a protrusion (pave) 141 of a blade operating lever 140 (described later). The cam board 134 has a through-hole 135 into which the shaft 130 is inserted; that is, the cam board 134 is rotatably mounted on the shaft 130.

Figure 12:
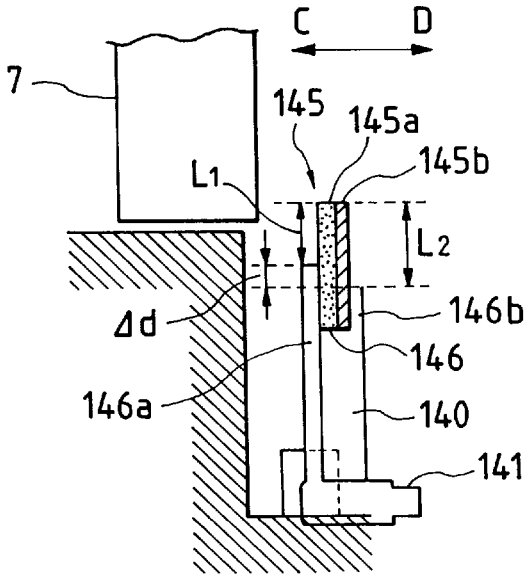
FIG. 12 is a sectional view of a blade and groove for securing the blade engaging with a blade operating lever.

A compression spring 136 is provided on the other side surface of the cleaner cam board 134, and with the protrusion 141 (FIG. 12) of the blade operating lever 140 engaged with the cam groove 132, the pump wheel is coupled to one surface of the pump frame 91 with a retaining board 150. Similarly, the other pump wheel is rotatably coupled to the other surface of the pump frame 91 with a retaining board 151.

The cam groove 132 has the following function: That is, the cam groove 132 prevents the slight vibrations of the pump wheels 110 and 111, which are caused by the elastic contact of the tubes 92 and 93 and the pulleys 101, 102, 103 and 104, from being propagated to the blade operating lever 140.

The blade operating lever 140 has an elongated groove 142 in the front end portion which is engaged with a pawl 241 of the pump frame 91, and an elliptic hole 144 in the rear end portion which is engaged with a protrusion 143 of the pump frame 91. The blade operating lever 140 has a groove 146 in the upper surface which accommodates a blade 145 of dual-layer structure which is formed by bonding a piece of felt to a rubber plate.

The blade operating lever 140 has a protrusion 140*a* at the center of the lower end portion of the supporting region of the blade 145, so that it is supported on the surface of a member 147 such as a platen 5 by point contact which is fixedly spaced from the recording heads 7 and 8. When the blade 145, being supported by point contact as was described above, is brought into contact with the recording heads 7 and 8, it can be moved in correspondence to the surfaces of the recording heads 7 and 8, thus being able to perform uniform wiping and rubbing operations.

The groove 146 is slightly inclined with respect to a direction perpendicular to the direction of movement of the carriage 1, so that ink mist which is formed by the rebounding of the blade during wiping or rubbing is prevented from being splashed towards the recording heads 7 and 8 and the recording sheet.

The lengths of two opposite wall surfaces 146*a* and 146*b* of the groove 146 which are extended in the direction of movement of the carriage, are different by as much as Δd from each other, and the free length L1 of the felt layer 145*a* forming the blade 145 is different from that L2 of the rubber layer 145*b*. Hence, the contact pressures of those layers 145*a* and 145*b* with the recording heads 7 and 8 can be adjusted; that is, the wiping force and the rubbing force can be adjusted.

After a printing operation, the cleaner unit 18 and the pump unit 16 are driven as follows: A change-over means (not shown) is operated to turn the motor 17 in one direction (in the direction of the arrow A in FIG. 7), thereby turning the pump wheels.

As a result, the pulleys 101 and 102, and 103 and 104 coupled to the wheels 110 and 111 are revolved. During revolution, the pulleys 101 and 102 of the wheel 110 are brought into contact with the damper tubes 105, so that their rotary shafts 101*a* and 101*b*, 102*a* and 102*b* are forcibly moved along the grooves 115 and 116 of the pump wheel 110 to the outermost end 115*a* and 116*a* (as indicated at 101 and 102 in the part (*a*) of FIG. 9). These shafts are positioned 180° symmetrical with respect to the center of rotation; i.e., diametrically opposite to each other by the locking piece 120 of the shaft 122, thus being elastically brought into contact with the tube 92.

Figure 9A:
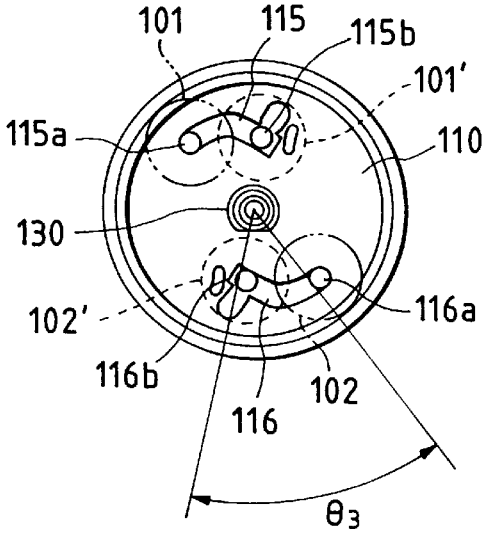
FIGS. 9(*a*) and 9(*b*) are diagrams showing pulley supporting grooves formed in two pump wheels, respectively.
Figure 9B:
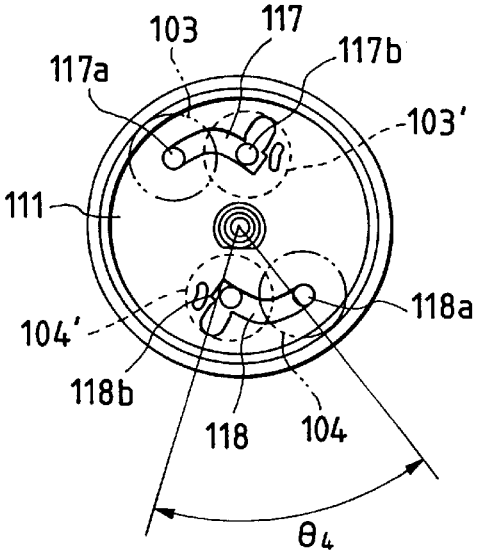

The pulleys 103 and 104 of the other wheel 111 are brought into contact with the damper tube 106 during revolution, so that the rotary shafts 103*a* and 104*a* of the wheel 111 are forcibly moved along the grooves 117 and 118 of the pump wheel 111 to the innermost ends 117*b* and 118*b* (as indicated at 103' and 104' in the part (*b*) of FIG. 9), thus being moved away from the pump tube 93.

When the motor is kept rotated under this condition, the tube 92 is squeezed against the tube supporting surface 94 of the frame 91 alternately by the two pulleys 101 and 102, to generate a suction force. The suction force thus generated is supplied through the tube 92 to the cap member 13 of the capping device 12, thus applying a negative pressure to the recording head 7, thereby forcibly discharging the ink.

Figure 11:
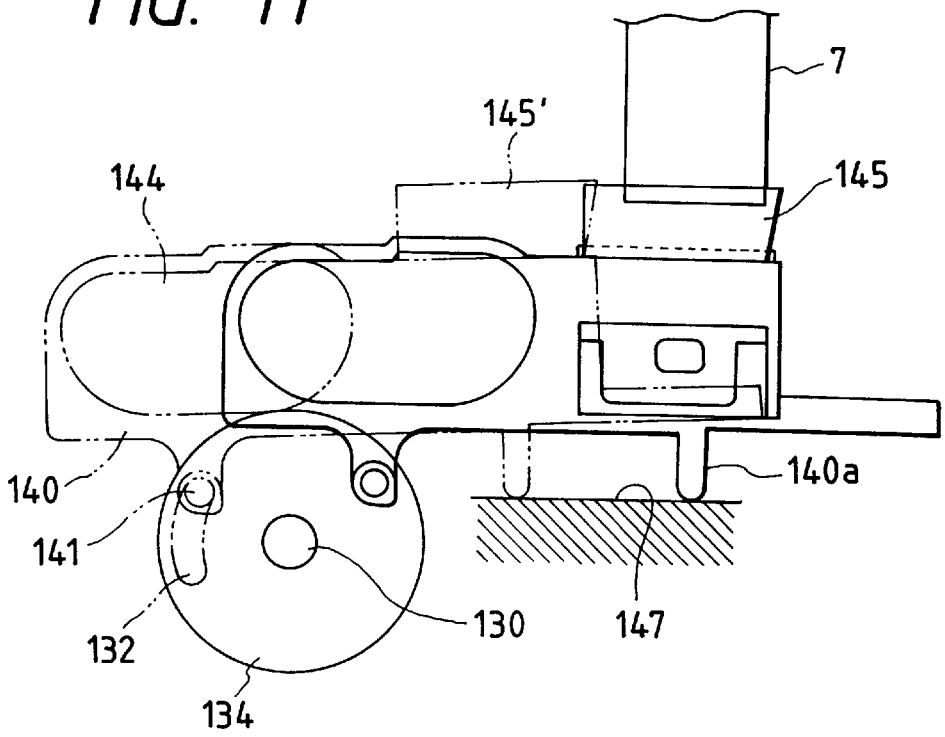
FIG. 11 is a diagram showing an example of a cleaner unit in the embodiment of the invention.

The rotation of the pump wheel is transmitted through the frictional clutch board 131 to the cleaner cam 134, so that the blade operating lever 140 is retracted from the path of movement of the recording heads 7 and 8 (as indicated at 145' in FIG. 11).

When the motor is rotated in the reverse direction (in the direction of the arrow B in FIG. 7), the pulleys 101 and 102 of the wheels 110 are brought into contact with the damper tube 105 during revolution, so that the rotary shafts 101*a* and 102*a* of the pulleys are forcibly moved along the grooves 115 and 116 of the pump wheel 110 to the inner most ends 115*b* and 116*b*, respectively (as indicated at 101' and 102' in FIG. 9), thus being moved away from the pump tube 92.

The pulleys 103 and 104 of the wheel 111 are brought into contact with the damper tube 106 during revolution, so that their rotary shafts 103*a* and 103*b*, and 104*a* and 104*b* are forcibly moved along the grooves 117 and 118 of the pump wheel 111 to the outermost ends 117*a* and 118*a* (as indicated at 103 and 104 in the part (*b*) of FIG. 9). These shafts are positioned 180° symmetrical with respect to the center of rotation; i.e., diametrically opposite to each other by the locking piece 121 of the shaft 123, thereby being elastically brought into contact with the tube 93.

When the motor is kept rotated in this state, the tube 93 is squeezed against the tube supporting surface 95 of the frame 91 alternately by the two pulleys 103 and 104, to generate a suction force. The suction force thus generated is supplied through the tube 93 to the cap member 14 of the capping device 12, thereby applying a negative pressure to the second recording head 8, and forcibly discharging the ink.

The rotation of the pump wheel 110 and 111 is transmitted through the frictional clutch board 131 to the cleaner cam 134, so that the blade operating lever 140 is moved into the path of movement of the recording heads 7 and 8 (as indicated at 145 in FIG. 11).

The tubes 92 and 93 are supported by the tube supporting surfaces 94 and 95 of the frame 91 so that their central contact angles with the pulleys 101 through 104 θ1 and θ2 are smaller than 180°. Hence, while the pulleys 101 and 103 are gradually moved away from the tubes 92 and 93 so that load torques given by the pulleys 101 and 103 are gradually decreased, the remaining pulleys 102 and 104, being brought into contact with the tubes 92 and 93, gradually squeeze the latter 92 and 93; that is, the load torques of the pulleys 103 and 104 are gradually but greatly changed to constant values.

Figure 13A:
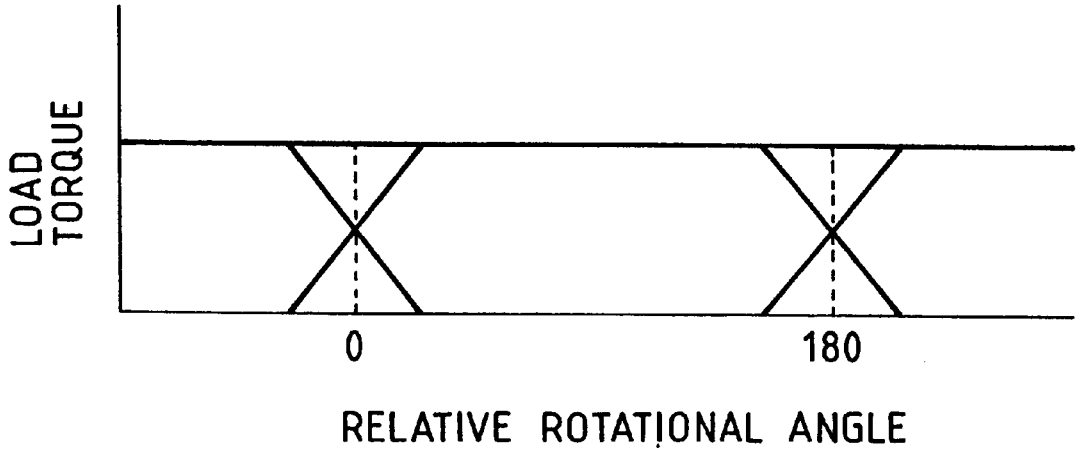
FIG. 13(*a*) is a graphical representation indicating load torque with rotational angle in the tube pump in the embodiment of the invention, FIG. 13(*b*) is also a graphical representation indicating load torque with rotational angle in the conventional tube pump.
Figure 13B:
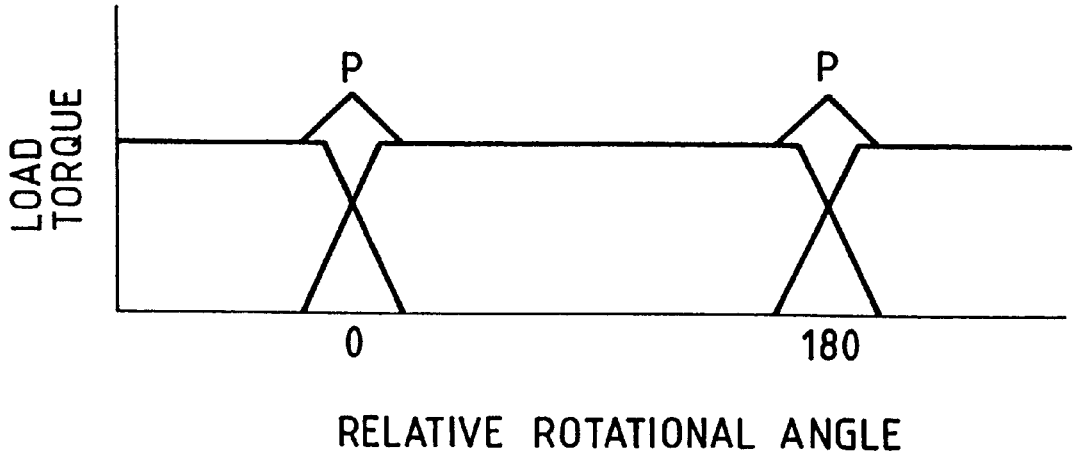
FIG. 13(b) PRIOR ART

Hence, when the pulleys 101 and 103 are switched over to the remaining pulleys 102 and 104, the load torque of the motor 17 is placed in a steady state (as indicated in the part (*a*) of FIG. 13) such that the two pulleys 101 and 103, or 102 or 104 squeeze the tubes 91 and 93 steadily. As a result, torque variation is much smaller than in the case where the pulley switching operation is carried out with a conventional tube pump (see FIG. 13(*b*)).

The central angles θ1 and θ2 of the squeezing regions are determined from the diameters of the pulleys 101 through 104, and the ratio of the radii of curvature of the tubes 92 and 93 in the region which concerns the pumping action. In the embodiment, the pulleys 101 through 104 have a diameter of 8 mm, and the radii of curvature of the tubes 92 and 93 are set to about 10 mm. Hence, the most suitable central angles θ1 and θ2 are 173°.

If the central angles θ1 and θ2 are excessively small, during the pumping operation, the time instants occur such that pulleys 101 through 104 leave the tubes 92 and 93. Therefore, the load torque is decreased in maximum value; however, the pulsation is increased. This is why the most suitable value exists.

When the recording heads 7 and 8 are cleaned with the blade 145, the carriage 1 is moved to the extent that the capping state can be eliminated. Under this condition, the motor 17 is turned in the direction of the arrow B so that the pump wheels 110 and 111 turn through angles θ3 and θ4, respectively. As a result, the pulleys 101 through 104 are moved along the pulley supporting grooves 115, 116, 117 and 118 of the pump wheels 110 and 111, but they do not squeeze the tubes 92 and 93. However, it should be noted that, in this operation, the cam groove 132 of the cleaner cam board 134 pushes the blade operating lever 104 towards the recording heads.

In this operation, the lower end of the blade operating lever 140 is guided along the surface of the member 147 with the aid of its protrusion 104*a* until the cleaning blade 145 is confronted with the recording heads 7 and 8; that is, the front end face is accurately positioned for the recording heads 7 and 8.

This movement may turn the pump wheels 110 and 111. In this case, the elastic contact of the tubes 92 and 93 with the pulleys 101, 102, 103 and 104 may result in the production of vibration. However, the propagation of the vibration to the blade operating lever 140 is prevented, and therefore the blade 145 is accurately set at the position suitable for cleaning.

In this configuration, the carriage 1 is slightly reciprocated in the directions of the arrows C and D, the recording heads 7 and 8 are rubbed by the blade 145, so that foreign matters such as waste ink or paper powder are removed from the surfaces of the recording heads.

After the cleaning operation, the motor 17 is turned in the opposite direction to turn the pump wheels 110 and 111 through the angle θ3. This method allows the blade 145 to retract to the position where it is not brought into contact with the recording heads 7 and 8.

As was described above, in the ink jet type recording apparatus of the invention, its capping means comprises:the slider which vertically moves the base stand in accordance with the movement of the carriage; the first cap member adapted to seal the first recording head, the first cap member being fixedly provided near the end, on the side of the printing region, of the slider, and having the air communication hole, and the ink suction hole in the bottom; the second cap member adapted to seal the second recording head, the second cap member being mounted through the elastic member on the slider, and having the air communication hole, and the ink suction hole in the bottom; the arm provided in the region below the first cap member, to perform a supporting operation in such a manner as to describe an arcuate locus as the carriage is moved; and the elastic member adapted to elastically push the arm upwardly of the printing region. Hence, the two cap members arranged spaced from each other can be elastically pressed against the recording heads with the aid of the elastic member, on the side of the front end, of the slider and the elastic member provided on the slide, so that the recording head can be positively sealed.

Furthermore, the ink jet type recording apparatus which, according to another aspect of the invention, comprises: the carriage on which the two ink jet type recording heads are mounted; the two cap members which are adapted to seal the nozzle openings of the recording heads, respectively; and the pump unit for applying negative pressure to the cap member, the pump unit comprising: the pump frame having the tube supporting surfaces which are set back to back to deform the tubes until the tubes become substantially semicircular in section; and the two pump wheels turned by the drive power of the drive means; the two pulleys rotatably engaged with grooves formed in each of the pump wheels in such a manner that, in the rotation thereof in one direction, the pulleys are positioned diametrically symmetrically with respect to the center of rotation of the pump wheel, to squeeze the tube, and in a rotation thereof in the opposite direction, the pulleys are moved away from the tube, and, in the pump frame, the maximum contact region of the tube and the pulleys is in a range of from 160° to 180°. Hence, the amount of load required when the abutment of the pulleys against the tube is relieved is substantially equal to that which is required when the tube is squeezed. In addition, the pump frame accommodates the damper tube, which contributes to miniaturization of the recording apparatus.

What is claimed is:

1. An ink jet type recording apparatus, comprising:

a carriage on which a first recording head having nozzle openings for jetting black ink, and a second recording head having nozzle openings for jetting color ink, are mounted, said first recording head being positioned on a side of said carriage proximate to a printing region of the recording apparatus, said second recording head being positioned on a side of said carriage proximate to a non-printing region of the recording apparatus, and said carriage being movable in a horizontal direction; and means for sealing said nozzle openings of said first recording head and said second recording head when said recording apparatus is not in operation, including:

a base stand which supports a slider, said slider being movable in a vertical direction relative to said base stand in accordance with the movement of said carriage;

a first cap member adapted to seal said first recording head, said first cap member being fixedly provided near an end of said slider that is proximate to the printing region, and having an air communication hole provided therein;

a second cap member adapted to seal said second recording head, said second cap member being mounted through elastic members on said slider, and having an air communication hole and an ink suction hole provided therein;

an arm for supporting said slider, said arm being provided in a region vertically below said first cap member, wherein said arm moves in an arcuate path when said carriage moves between the printing and non-printing regions; and an elastic member adapted to elastically push said arm vertically upward of said printing region.

2. An ink jet type recording apparatus as claimed in claim 1, further comprising a valve unit provided between said first and second cap members, said valve unit comprising:

a stationary valve seat; and a movable valve seat;

said stationary valve seat having an opening which is sealed when said slider abuts against said movable valve seat, said movable valve seat being moved by a lever which is elastically pressed by a spring at all times and which is swung, being abutted against said base stand, when said carriage is moved to a lost suction position, and having an opening which is sealed with said stationary valve seat, and a through-hole of said stationary valve seat and a through-hole of said movable valve seat being connected to said air communication holes of said cap members, respectively.

3. An ink jet type recording apparatus as claimed in claim 1, wherein:

said second cap member comprises:

a cap; and a frame supporting said cap, said second cap member having a guide member at an end of said frame, proximate to the printing region, which swingably engages with said slider, thus moving said second cap member into position with respect to said second recording head.

4. An ink jet type recording apparatus as claimed in claim 1, wherein said second cap member has radial grooves which radially extend from the periphery of said air communication hole, and accommodates an ink absorbing sheet.

5. An ink jet type recording apparatus, comprising:

a carriage on which two ink jet type recording heads having nozzle openings for jetting ink are mounted;

two cap members which are adapted to seal said nozzle openings of said recording heads, respectively; and a pump unit for applying negative pressure to said cap members, said pump unit comprising:

a plurality of tubes used for transmitting a suction force;

a pump frame having tube supporting surfaces which are set back to back to deform said tubes until said tubes become substantially semi-circular in section;

two pump wheels turned by drive means; and two pulleys rotatably engaged with grooves formed in each of said pump wheels such that, in a rotation thereof in one direction, said pulleys are positioned diametrically symmetrically with respect to a center of rotation of each of said pump wheels, to squeeze each of said tubes to generate said suction force, and in a rotation thereof in an opposite direction, said pulleys are moved away from each of said tubes, and in said pump frame, a maximum contact region of each of said tubes and said pulleys ranges from 160° to 180°; and a cleaner unit engaged through means for transmitting rotation of one of said pump wheels, said cleaner unit being moved to a position within a range of movement of each of said pulleys along a length of said groove, where said cleaner unit can be brought into contact with or moved away from said recording heads.

6. An ink jet type recording apparatus as claimed in claim 5, wherein said pump frame has damper tubes which are provided in such a manner that said damper tubes are positioned on the loci of rotation of said pulleys.

7. An ink jet type recording apparatus as claimed in claim 6, wherein a first member forming a part of said cleaner unit abuts against a second member which defines a platen surface.

8. An ink jet type recording apparatus as claimed in claim 7, wherein said cleaner unit is in point contact with said second member which defines said platen surface.

9. An ink jet type recording apparatus as claimed in claim 6, wherein said rotation transmission means has a predetermined play angle with respect to said one of said pump wheels.

10. An ink jet type recording apparatus as claimed in claim 6, wherein said cleaner unit further comprises:

a blade, comprising:

two layers different in respective material which are arranged in a direction of movement of said carriage, and which are provided such that free lengths of said two layers from a front end thereof are different from each other.

11. An ink jet type recording apparatus, comprising:

a carriage on which a first recording head having nozzle openings for jetting black ink, and a second recording head having nozzle openings for jetting color ink, are mounted, said first recording head being positioned on a side of said carriage proximate to a printing region of the recording apparatus, said second recording head being positioned on a side of said carriage proximate to a non-printing region of the recording apparatus, and said carriage being movable in a horizontal direction;

means for sealing said nozzle openings of said first recording head and said second recording head when said recording apparatus is not in operation, including:

a base stand which supports a slider, said slider being movable in a vertical direction relative to said base stand in accordance with the movement of said carriage;

a first cap member adapted to seal said first recording head, said first cap member being fixedly provided near an end of said slider that is proximate to the printing region, and having an air communication hole provided therein;

a second cap member adapted to seal said second recording head, said second cap member being mounted through elastic members on said slider, and having an air communication hole and an ink suction hole provided therein;

an arm for supporting said slider, said arm being provided in a region vertically below said first cap member, wherein said arm moves in an arcuate path when said carriage moves between the printing and non-printing regions; and an elastic member adapted to elastically push said arm vertically upward of said printing region; and a valve unit provided between said first and second cap members, said valve unit comprising:

a stationary valve seat; and a movable valve seat;

said stationary valve seat having an opening which is sealed when said slider abuts against said movable valve seat, said movable valve seat being moved by a lever which is elastically pressed by a spring at all times, and which is swung, being abutted against said base stand, when said carriage is moved to a lost suction position, and having an opening which is sealed with said stationary valve seat, and a through-hole of said stationary valve seat and a through-hole of said movable valve seat being connected to said air communication holes of said cap members, respectively.

12. An ink jet type recording apparatus, comprising:

a carriage on which two ink jet type recording heads having nozzle openings for jetting ink are mounted;

two cap members which are adapted to seal said nozzle openings of said recording heads, respectively;

a pump unit for applying negative pressure to said cap members, said pump unit comprising:

a plurality of tubes used for transmitting a suction force;

a pump frame having tube supporting surfaces which are set back to back to deform said tubes until said tubes become substantially semi-circular in section;

two pump wheels turned by drive means; and two pulleys rotatably engaged with grooves formed in each of said pump wheels such that, in a rotation thereof in one direction, said pulleys are positioned diametrically symmetrically with respect to a center of rotation of each of said pump wheels, to squeeze each of said tubes to generate said suction force, and in a rotation thereof in an opposite direction, said pulleys are moved away from each of said tubes, and in said pump frame, a maximum contact region of each of said tubes and said pulleys ranges from 160° to 180°;

wherein said pump frame has damper tubes which are provided such that said damper tubes are positioned on the loci of rotation of said pulleys; and a cleaner unit engaged through means for transmitting rotation of one of said pump wheels, said cleaner unit being moved to a position within a range of movement of each of said pulleys along a length of said groove, where said cleaner unit can be brought into contact with or moved away from said recording heads.

* * * * *